US005873767A

United States Patent [19]

Pickett

[11] Patent Number: 5,873,767

[45] Date of Patent: Feb. 23, 1999

[54] TORSO-SUPPORT GARMENT FOR WOMEN

[76] Inventor: Sharron Pickett, 17160 Meyers, #32, Detroit, Mich. 48235

[21] Appl. No.: 854,358

[22] Filed: May 12, 1997

[51] Int. Cl.[6] ..... A41C 3/00; A41C 3/12

[52] U.S. Cl. ..... 450/1; 450/91; 450/92; 2/73

[58] Field of Search ..... 450/1, 8, 10, 11, 450/12, 13, 14, 15, 16, 17, 19, 20, 21, 22, 23, 30, 31, 32, 37, 39, 40, 49, 60, 61, 62, 65, 68, 66, 67, 70, 74, 75, 76, 79, 82, 80, 83, 84, 90, 91, 92, 93; 2/67, 73, 109, 110, 105, 106

[56] References Cited

U.S. PATENT DOCUMENTS

| | | | |
|---|---|---|---|
| 1,849,514 | 3/1932 | Edelmann | 450/91 |
| 2,425,145 | 8/1947 | Coleman | 450/92 |
| 2,486,836 | 11/1949 | Garson | 450/91 |
| 2,966,785 | 1/1961 | Goff et al. | 450/91 X |
| 4,100,924 | 7/1978 | Rosenberg | 450/86 |
| 4,637,398 | 1/1987 | Sherwood | 450/54 |
| 4,909,771 | 3/1990 | Bergman | 450/3 |

*Primary Examiner*—Jeanette E. Chapman
*Attorney, Agent, or Firm*—Kohn & Associates

[57] ABSTRACT

The torso-support garment provides increased support for larger women that is useful as an undergarment, as a bra-top for outerwear, or as the top of a two-piece swimsuit. The garment comprises an inner and an outer bra attached together. Each inner cup is attached to an outer cup and each inner backstrap is attached to an outer backstrap. The inner bra is made of a heavyweight powerknit fabric having two-way stretch properties.

6 Claims, 2 Drawing Sheets

TORSO-SUPPORT GARMENT FOR WOMEN

FIELD OF USE

A garment for larger women that provides the necessary support and comfort and can be worn as a bra-top, a brassiere, or the top of a two-piece swimsuit.

BACKGROUND OF THE INVENTION

Often larger women do not have the necessary support with conventional garments. As a result, they may feel self-conscious and even limit their physical activities. Numerous designs have been proposed:

U.S. Pat. No. 5,211,598 (Hall) discloses an exercise brassiere that provides breast support and is comfortable to wear, the brassiere having an outer, a middle, and an inner layer, the brassiere being supported from the shoulder to the waistband of the wearer. The fabric material has a significantly greater stretchability in the horizontal direction than in the vertical direction.

U.S. Pat. No. 5,033,986 (Feigenbaum et al.) discloses a woman's bodysuit for swimming, exercising or other athletic activities, the bodysuit being soft and comfortable, while providing support in the torso, the bodysuit including a full and partial bra liner for support.

U.S. Pat. No. 4,654,894 (Kudo) discloses a one-piece swimsuit, wherein the bra portion includes inner shaped cups, functioning as underwear and eliminating the need for a garment supporter under the swimsuit.

U.S. Pat. No. 4,143,662 (Fisher) discloses a brassiere having two cups and supporting straps that provide a seamless-type brassiere, being made of one-hundred percent nylon material similar to the material used in panty hose.

What is needed is a torso-support garment for larger women that can be worn for all occasions and provides the necessary comfort and support.

What is needed is a torso-support garment for larger women that can be worn as an undergarment, a bra-top, or the top of a two-piece swimsuit.

What is needed is a torso-support garment specifically designed for larger women, which can be worn all day and every day, which can even be worn for aerobics and other athletic activities, which provides the necessary support and comfort, which looks like a conventional garment, which will withstand repeated machine washings, and which can be readily made from available materials.

SUMMARY OF THE INVENTION

The torso-support garment of the present invention provides increased support for larger women. The garment comprises an inner bra securely attached to an outer bra. The torso-support garment is useful as an undergarment, as a bra-top worn as outerwear, or as the top of a two-piece swimsuit.

To provide additional support, the inner bra and the outer bra each include a pair of cooperating backstraps and a pair of cooperating shoulder-straps. Each inner shoulder strap is secured to an outer shoulder strap, and each inner backstrap is secured to each outer backstrap. To provide maximum support, each bra also is made of a heavy powerknit support material.

When used as an undergarment, the garment will also include a pair of inner cooperating shoulder straps, each inner cooperating backstrap being attached to one of a pair of outer cooperating backstraps. The shoulder straps are optional for a bra-top or a swimsuit.

In a first embodiment, each portion of the inner bra is secured to each respective portion of the outer bra. Each inner cup is secureably attached to the appropriate outer cup, each inner cooperating backstrap is secureably attached to an outer cooperating backstrap, and each inner cooperating shoulder strap is secureably attached to an outer cooperating shoulder strap. In a second embodiment the perimeter of the inner bra is secured to the perimeter of the outer bra.

For a more complete understanding of the women's torso-support garment of the present invention, reference is made to the following detailed description and accompanying drawings in which the preferred embodiments of the current invention are shown by way of example. As the invention may be embodied in many forms without departing from the spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENTS

Figure 1:
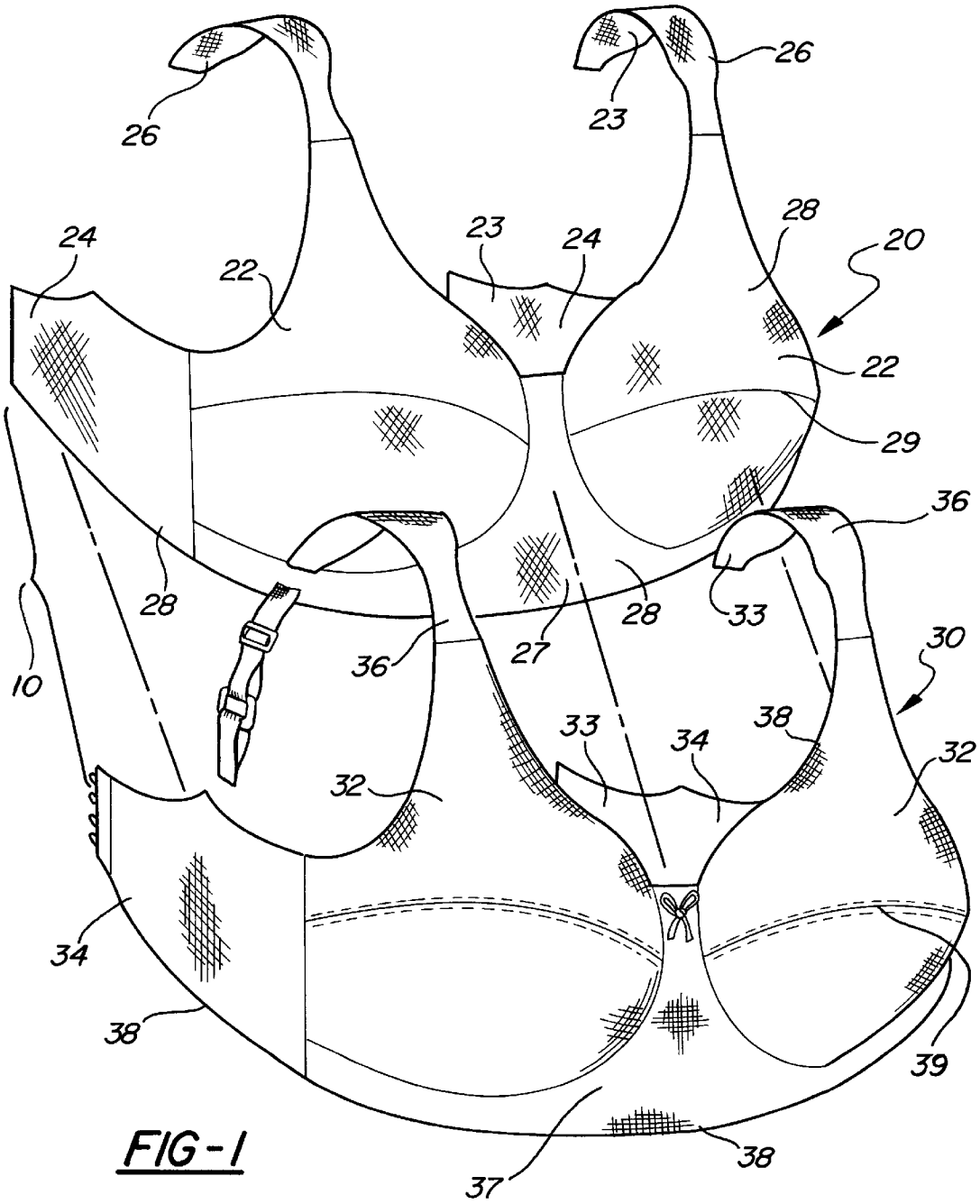
FIG. 1 is an assembly view of the preferred embodiment of the torso-support garment of the present invention shown as comprising an inner and outer bra.

The torso-support garment [10] of the present invention as shown in FIG. 1 comprises an inner bra [20] securely attached to an outer bra [30].

The material of the inner bra [20] stretches both horizontally and vertically. The inner bra [20] includes a pair of inner cups [22] and a pair of cooperating straps [23]. The material of the outer bra [30] also stretches both horizontally and vertically. The outer bra [30] includes a pair of outer cups [32], and a pair of outer cooperating straps [33].

The pair of cooperating straps [23 or 33] may be either the backstraps [24 and 34] or the shoulder straps [26 and 36]. To provide improved support, the torso-support garment [10] includes both the backstraps [24 and 34] and the shoulder straps [26 and 36]. Each backstrap [24] of the inner bra [20] is secured to each respective backstrap [34] of the outer bra [30], and each shoulder strap [26] of the inner bra [20] is secured to each respective shoulder strap [36] of the outer bra [30].

The shoulder straps [26 and 36] are broadened and padded for comfort. The backstraps [34] of the outer bra [30] are engageable by a plurality of hook and loop fasteners [31] or other conventional means, as it is unnecessary for both bras [20 and 30] to include the fasteners.

Figure 2:
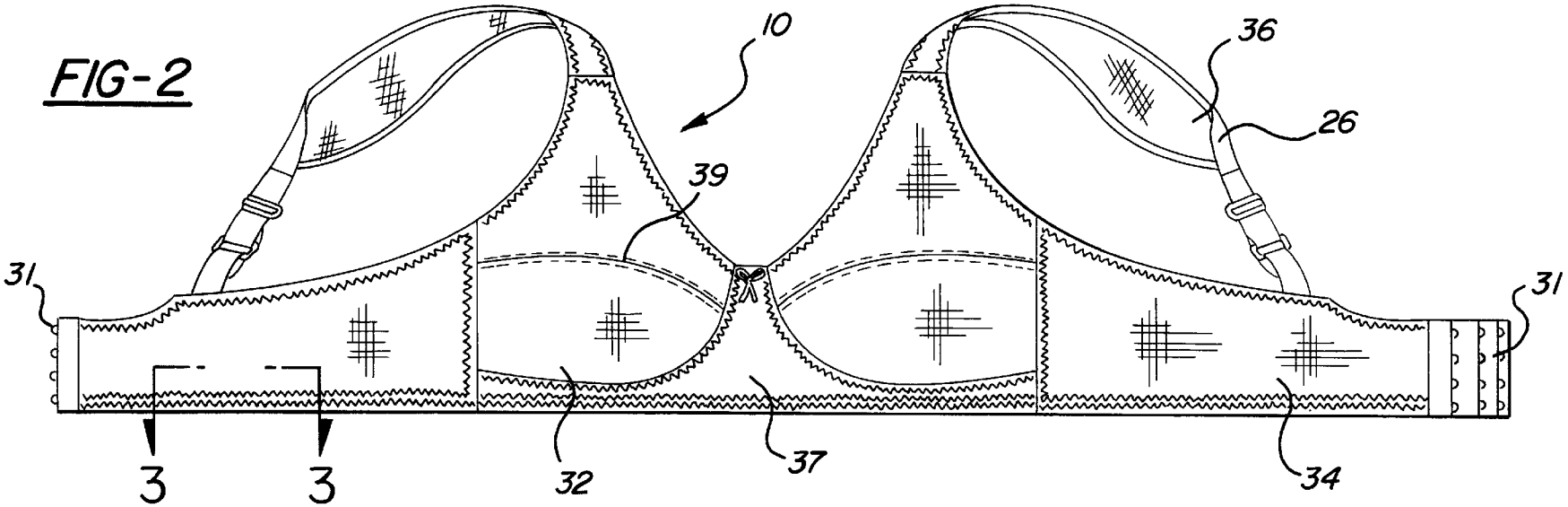
FIG. 2 shows a front elevational view of the embodiment of the torso-support garment of FIG. 1.
Figure 3:
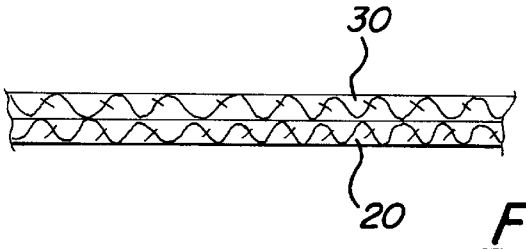
FIG. 3 shows a sectional view of the torso-support garment taken through Section 3—3 of FIG. 2.

In a first embodiment, each portion of the inner bra [20] is independently secured to each respective portion of the outer bra [30] as shown in FIGS. 2 and 3. Each inner cup [22] is secureably attached to the appropriate outer cup [32], each inner cooperating backstrap [24] is secureably attached to an outer cooperating backstrap [34], and each inner cooperating shoulder strap [26] is secureably attached to an outer cooperating shoulder strap [36].

In a second embodiment only the perimeter [28] of the inner bra [20] is secured to the perimeter [38] of the outer bra [30]. The perimeter [38] of the front portion [37] of the outer bra [30] (which includes the cups [32]) and the perimeter [28] of the shoulder straps [36] and backstraps [34] are each secured to the corresponding portions of the inner bra [20].

The inner and outer bra [20 and 30] need not be made from the same material, but preferably at least one is made from a support material that is more stretch resistant than the other material. The support material of choice is a heavyweight powerknit fabric having two-way stretch. Generally, the inner material will be the support material. To provide maximum support, both bras [20 and 30] are made from the support material.

The cups [22 and 32] of each bra [20 and 30] may also include a horizontal seam [29 and 39] stitched horizontally thereacross. The additional material in the seam provides extra support. Also, the seams [29] of the inner cups [22] may be secured to the respective seams [39] of the outer cups [32].

Figure 4:
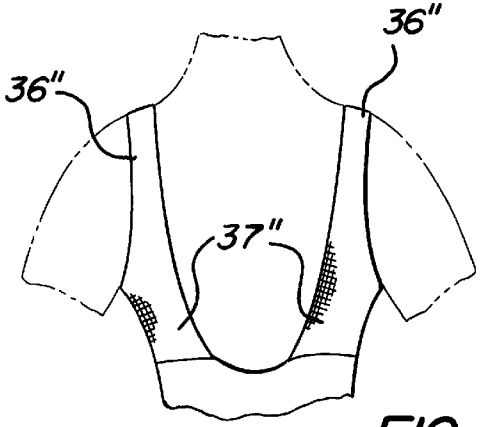
FIG. 4 shows a rear view of another embodiment of the torso-support garment wherein the shoulder strap is secured to the front portion without a backstrap.

In one variation, the inner and outer bras [20' and 30'] comprise only the front portions [27' and 37'] and the backstraps [24' and 34'], as the backstraps [24' and 34'] are secured directly to the front portions [27' and 37'] (not shown). In another variation, the inner and outer bras [20"and 30"] may comprise only the front portions [27"and 37"] and the shoulder straps [26"and 36"], as the shoulder straps [26"and 36"] are secured directly to the front portions [27"and 37"] (see for example FIG. 4). Both of these embodiments are more common for bra-top outerwear.

The support material of choice is a heavyweight powerknit material which is commonly used in girdle construction for firm support, having two-way stretch properties. The material is 80 percent nylon and 20 percent lycra having a 420 denier construction with a weight of six ounces per square yard. The material is commercially available from Minnetonka Mills, Inc. of Hopkins, Minn. as Catalog No. 0020-19 (white) and 0020-23 (black).

The design of the torso-support garment [10] can be used as an undergarment, as a bra-top for outerwear, and also as a top of a two-piece swimsuit.

It is evident that many alternatives, modifications, and variations of the women's torso-support garment [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

I claim:

1. A torso-support garment that provides increased support for a woman, the garment comprising an inner bra made of an inner material that stretches horizontally and vertically, the inner bra including an inner cup disposed on an inner front portion and a pair of inner cooperating backstraps;

an outer bra made of an outer material that stretches horizontally and vertically, the outer bra including an outer cup disposed on an outer front portion and a pair of outer cooperating backstraps, the inner bra being secureably attached to the outer bra, the inner cup being secureably attached to the outer cup, the each inner cooperating backstrap being secureably attached to an outer cooperating backstrap, the inner material being more stretch resistant than the outer material, the inner material being a heavyweight powerknit fabric having two-way stretch; and a pair of inner cooperating shoulder straps that are secured to the inner front portion and the inner backstrap of the inner bra, each outer bra including a pair of outer cooperating shoulder straps that are secured to the outer front portion and an outer backstrap, each inner cooperating shoulder strap being attached to an outer cooperating shoulder strap.

2. The reinforced torso-support garment of claim 1, wherein the cooperating backstraps include adjustable inward support and the cooperating shoulder straps include adjustable upward support.

3. A torso-support garment that provides increased support for a woman, the garment comprising:

an inner bra front portion made of an inner material that stretches horizontally and vertically, the inner bra front portion including an inner cup, an outer bra front portion made of an outer material that stretches horizontally and vertically, the outer bra front portion including an outer cup, the inner bra front portion being secureably attached to the outer bra front portion, the inner cup being secureably attached to the outer cup, the inner material being more stretch resistant than the outer material, the inner material being a heavyweight powerknit fabric having two-way stretch, the inner front portion and the outer front portion forming combined front portion, the combined front portion having a first end and a second end;

one and only one pair of opposing and cooperating shoulder straps, one of the pair of cooperating shoulder straps being secured to the first end of the combined front portion, the other of the pair of cooperating shoulder straps being secured to the second end of the combined front portion, the pair of shoulder straps being nonreinforced; and a pair of opposing cooperating backstraps, one of the pair of cooperating backstraps being secured to the combined front portion and one of the shoulder straps, the other of the pair of cooperating backstraps being secured to the combined front portion and the other of the shoulder straps.

4. The reinforced torso-support garment of claim 3, wherein the cooperating backstraps include adjustable inward support and the cooperating shoulder straps include adjustable upward support.

5. A torso-support garment that provides increased support for a woman, the garment comprising:

an inner bra front portion made of an inner material that stretches horizontally and vertically, the inner bra front portion including an inner cup, an outer bra front portion made of an outer material that stretches horizontally and vertically, the outer bra front portion including an outer cup, the inner bra front portion being secureably attached to the outer bra front portion, the inner cup being secureably attached to the outer cup, the inner material being more stretch resistant than the outer material, the inner material being a heavyweight powerknit fabric having two-way stretch, the inner front portion and the outer front portion forming combined front portion, the combined front portion having a first cup top and a second cup top;

one and only one pair of opposing and cooperating backstraps, one of the pair of cooperating backstraps being secured to the first cup top of the combined front portion, the other of the pair of cooperating backstraps being secured to the second cup top of the combined front portion, the pair of backstraps being nonreinforced; and a pair of opposing cooperating shoulder straps, one of the pair of cooperating shoulder straps being secured to the combined front portion and one of the backstraps, the other of the pair of cooperating shoulder straps being secured to the combined front portion and the other of the backstraps.

6. The reinforced torso support garment of claim 5, wherein the cooperating backstraps include adjustable inward support and the cooperating shoulder straps include adjustable upward support.

* * * * *